US005124897A

United States Patent [19]

Kraus

[11] Patent Number: 5,124,897

[45] Date of Patent: Jun. 23, 1992

[54] LAMP HOLDER OR SOCKET TO RECEIVE AN INCANDESCENT LAMP BULB

[75] Inventor: Willibald Kraus, Grunstadt, Fed. Rep. of Germany

[73] Assignee: TRW United-Carr GmbH & Co. KG, Alsenborn, Fed. Rep. of Germany

[21] Appl. No.: 619,718

[22] Filed: Nov. 29, 1990

[30] Foreign Application Priority Data

Dec. 1, 1989 [DE] Fed. Rep. of Germany ..... 3939830

[51] Int. Cl.[5] ..... H01R 4/58

[52] U.S. Cl. ..... 362/226; 362/253; 439/86; 439/89; 439/699

[58] Field of Search ..... 439/86, 88, 89, 90, 439/699; 362/226, 381, 253

[56] References Cited

U.S. PATENT DOCUMENTS 3,371,306 2/1968 Moranduzzo ..... 439/699
4,921,453 5/1990 O'Brien ..... 439/86
4,936,788 6/1990 Lin ..... 439/699
4,957,455 9/1990 Horiuchi et al. ..... 439/699
4,975,066 12/1990 Sucheski et al. ..... 439/699

*Primary Examiner*—Ira S. Lazarus
*Assistant Examiner*—Y. Quach
*Attorney, Agent, or Firm*—Fay, Sharpe, Beall, Fagan, Minnich & McKee

[57] ABSTRACT

A lamp holder or socket 1 is intended to receive an incandescent lamp bulb 2, especially a glass socket lamp or a plastic socket lamp. Two contact elements 8 and 9 are supported within the holder and are connected within the holder with the contact wires of the glass socket lamp and the electrical supply lead or plug holder. The two contact elements 8, 9 are formed in each case from an electroconductive plastic material. The holder also has an outer sheath 10 which encloses the contact elements 8, 9, and an inner wall which defines a separation zone 11 arranged within the holder 1 to insulate the contact elements 8, 9 from each other.

11 Claims, 3 Drawing Sheets

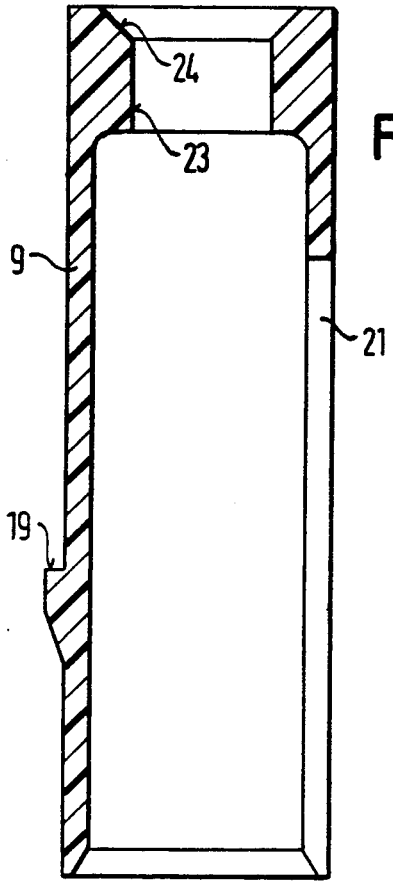
FIG. 4
FIG. 7
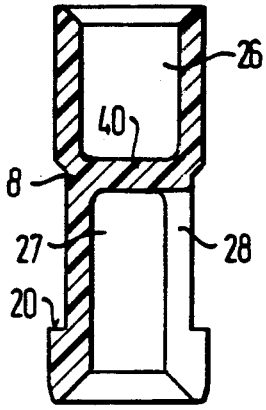
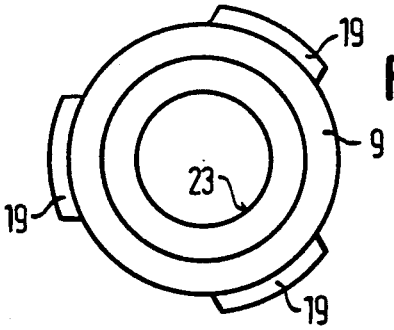
FIG. 5
FIG. 8
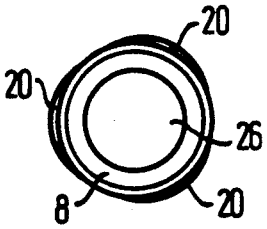
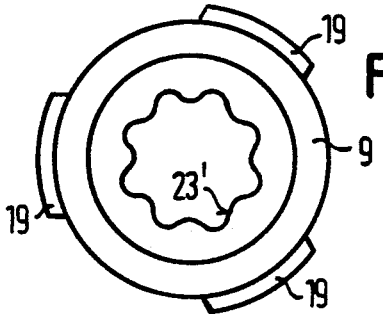
FIG. 6
FIG. 9
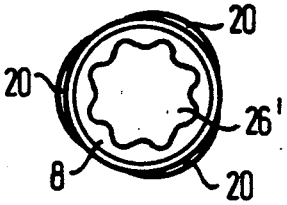

LAMP HOLDER OR SOCKET TO RECEIVE AN INCANDESCENT LAMP BULB

BACKGROUND OF THE INVENTION

The invention relates to a lamp holder or socket assembly to receive an incandescent lamp bulb.

Already known in the prior art is a lamp holder designed to receive an incandescent lamp which includes within an outer sheath, guides of sheet metal which have both spring elements and curved tracks. (German Disclosure 2,628,127; and, German published applications 1,464,176 and 2,310,151). A disadvantage of such a holder is the considerable mounting and cost expense for the production and arrangement of the individual metal elements within the lamp holder.

Also known in the prior art is electroconductive plastic which has an electrically conductive component or content and which can be processed, for example, by injection molding or extrusion. (German Disclosures 3,409,953, 3,305,401, 3,245,589, and 3,238,246). These electroconductive plastics can be used as electrical connection bodies.

On the other hand, the present invention attacks the problem of designing a lamp holder of the kind mentioned, so that a simple, cost-saving structure is given and in which the cost of mounting is also kept low.

This problem is solved, according to this invention, by the features in the distinguishing part of claim 1. Since, according to the invention, both contact elements are comprised, in each case, of an electroconductive plastic material, and the holder has an outer sheath surrounding the contact elements with a wall defining an inner separation zone arranged inside the holder which functions to insulate the contact elements from each other, the cost-intensive and elaborate production of contact elements of metal is eliminated.

In one form of the invention, the outer sheath and the inner separation zone may comprise a one-piece unit. In this case, the contact elements are also designed sheath-like, and can be set into the spaces between the outer sheath and the inner separation zone, and into the inner space of the inner separation zone with a stop provided in this position. In this form, production may take place in a two-component injection molding process.

As an alternative, it is also possible for the outer sheath and the wall defining the inner separation zone to be designed as connection parts and thus to be made as two separate units. Here, the two contact parts may, to advantage, be designed substantially identical, in each case, with a half-shell and a clip fastening zone and a connection zone projecting out of the outer sheath. This construction gives a further economy since the two contact elements are of identical form and are insulated from each other through the connection part. This unit is then arranged within the outer sheath.

BRIEF DESCRIPTION OF THE DRAWINGS

The objects and advantages of the invention are described in detail below and will become apparent from the description given in conjunction with the accompanying drawings wherein:

FIG. 4 is a longitudinal cross-section taken through the outer contact element of FIG. 1;

FIG. 5 is a top view of the element shown in FIG. 4;

FIG. 6 is another embodiment or form for the outer contact element of FIG. 4 in top view;

FIG. 7 is a side view in longitudinal cross-section of the inner contact element;

FIG. 8 is a top view of the contact element illustrated in FIG. 7;

FIG. 9 is a view like FIG. 8 showing another possible form of execution of the illustrated contact element shown in FIG. 7, in top view;

DETAILED DESCRIPTION OF THE PREFERRED EMBODIMENT

Figure 1:
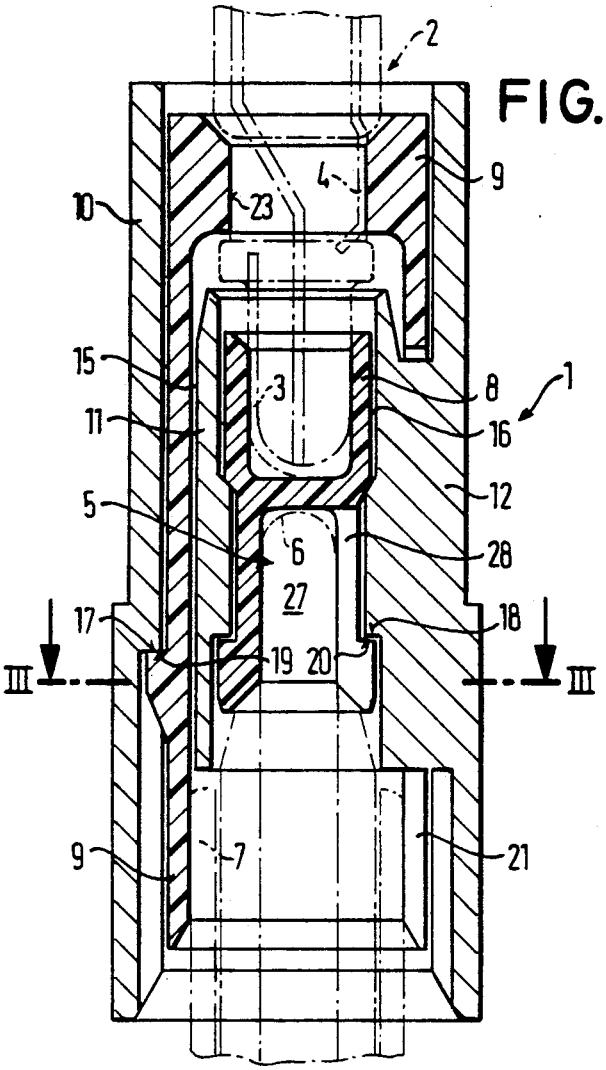
FIG. 1 is a longitudinal cross-section through a lamp holder formed in accordance with a preferred embodiment of the invention.
Figure 2A:
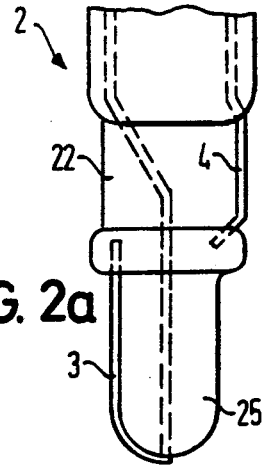
FIG. 2*a* is a side view of the lower end of a glass socket lamp.
Figure 2B:
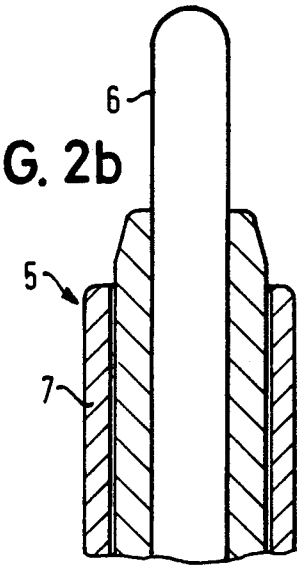
FIG. 2*b* is a side view, partially in section of the upper end of a current-carrying electrical feed line plug end.

Referring more particularly to the drawings where the showings are for the purpose of illustrating the preferred embodiment of the invention and not for the purposes of limiting the same, the first form of execution is represented in FIG. 1 and comprises a lamp holder 1 which serves to receive and functionally join or hold together a glass socket lamp or bulb 2 with a current-carrying feed line plug end part 5. The base portion of the glass socket lamp or bulb 2 is best illustrated in FIG. 2*a* and has two contact wires 3 and 4 which are electrically and spacially separated from each other. The bulb base also includes a bearing zone 22 and a lamp plug portion 25. The current-carrying feed line plug end 5 has, according to FIG. 2*b*, two feed lines or contact portions 6 and 7, insulated from each other by a central sleeve.

According to FIG. 1, the lamp holder 1 is comprised of two socket-form contact elements 8 and 9. An outer sheath 10 encloses these contact elements and an inner separation zone 11 is provided by an interior wall arranged inside the holder 1. The interior wall serves to insulate the contact elements 8 and 9 from each other. Here, the outer sheath 10 and the inner separation zone are designed and formed as a unitary one-piece unit.

The two contact elements 8 and 9 are preferably formed from an electroconductive plastic material and are, in each case, of a cylindrical shell shape.

Figure 3:
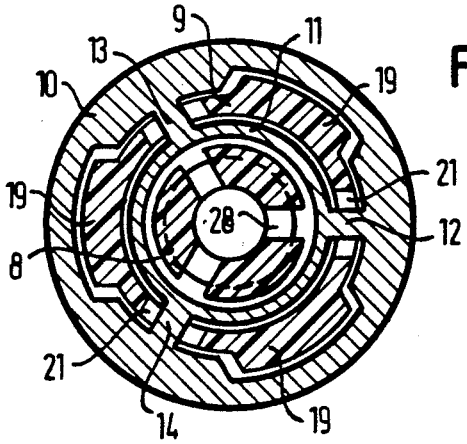
FIG. 3 is a section taken along the line III—III of FIG. 1.
Figure 10:
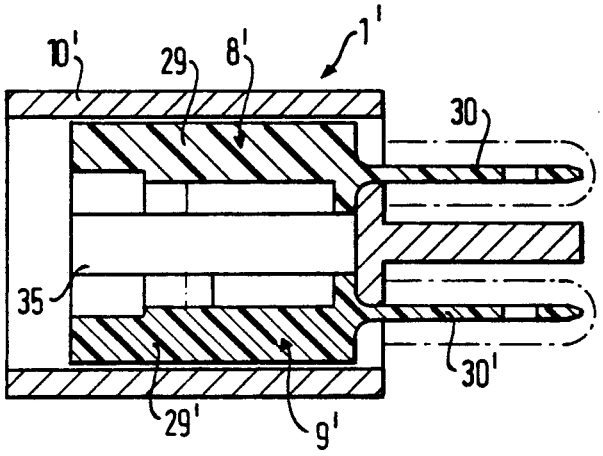
FIG. 10 is another embodiment of the lamp holder (the view is a longitudinal cross-section view) taken along line X—X in FIG. 11.

As can be seen from FIGS. 1 and 3, the outer shell 10 is connected with the inner wall which defines separation zone 11 by, for example, three radially extending connecting webs or stays 12, 13, 14 equally spaced and arranged around the circumference. Into the space 15 between the outer shell 10 and the inner wall of separation zone 11 is set the shell-shaped outer contact element 9. Into the inner space 16 defined by the inner wall of separation zone 11 is set the inner contact element 8. Both contact elements 8 and 9 are set in a manner to be secure against being vibrated loose or lost from within the respective spaces 15 and 16.

For secure holding in operation, both of the shell-shape contact elements s and 9 have at least one latch-type stop surface 19 and 20, respectively. These stop surfaces 19 and 20 may also lie against a corresponding shoulder 17 or 18, of the outer shell 10 or the inner wall of separation zone 11, respectively.

To assure the correct arrangement of the outer contact element 9 between the outer shell 10 and the wall of inner separation zone 11, the outer contact element 9 has at least one longitudinal slit 21 (see FIG. 4). The number of slits 21 corresponds to the number of stays (e.g., 12, 13, 14) between this outer shell 10 and the inner separation zone 11. This number can, of course, vary.

It can also be seen from FIG. 4 that the outer contact element 9 has a shoulder or necked-in bearing zone 23 which runs out into a cone shape 24 at the outer end. This necked-in bearing zone 23 is sized to be only slightly larger in diameter than the diameter of the bearing zone 22 of the glass socket lamp 2 to be held (see FIG. 2*a*).

From FIGS. 5 and 6, it can be seen that the bearing zone 23 may have either a true cylindrical form 23 or a regular or irregular profiled form 23'. These two figures also show that the out contact element has at least one stop surface 19.

FIG. 7 represents the inner contact element 8. This element has two holes or sockets 26 and 27 which are separated from each other by a transverse inner wall 40. Also, the socket hole 27 is divided by preferably at least one slit 28 to provide radial resiliency and allow the element to snap into the assembled position illustrated in FIG. 1. The diameter of the socket hole 26 is slightly larger than the diameter of the plug portion 25 of the glass socket lamp 2 as shown in FIG. 2*a*. The diameter of the socket hole 27 of the inner contact element 8 is made slightly larger than the feed line 6 of the current-carrying feed part 5. In both situations, the size is such as to assure good electrical contact between the inner wall of the socket hole (26 or 27) and the respective lead wires (3 or 6).

If the lamp holder 1 of FIG. 1 (comprising outer shell 10, outer contact element 9, inner contact element 8, and inner separation zone 11) is mounted correctly, the glass socket lamp or bulb 2 can be pushed in from above and the bearing zone 22 of the glass socket lamp or bulb 2 is supported in the elastic bearing zone 23 of the outer contact element. After mounting, the contact wire 3 engages the inner contact element 8. The other contact wire 4 engages the outer contact element 9.

The current-carrying feed line plug part 5 can be introduced from below into the lamp holder of the invention. When properly positioned, the feed line 6 is supported in the lower socket hole 27 of the inner contact element 8. The outer feed line 7 engages by its outer surface, the inner wall of the outer contact element 9. Thus, in a functionally correct way, an electrical connection is given between the contact wires 3 and 4 of the glass socket lamp 2 with the feed lines 6 and 7 of the current-carrying feed part 5.

Since the contact elements 8 and 9 consist of electroconductive plastic material there is a considerable simplification of the whole structure, and a cost-saving mounting is provided.

As can be seen, the stop surfaces 19 and 20 of the inner and outer contact elements 8 and 9, respectively, lie against the corresponding shoulders 17 and 18, of the outer shell 10 and the wall of the inner separation zone 11, respectively. Thus, there is an exact adjustment of the individual elements within the outer shell 10 of the lamp holder 1 of the invention.

As an alternative to the separate forming of the individual components, it is possible to produce the whole assembly in a two-component injection molding process.

FIGS. 10 to 13 show another possible embodiment of the lamp holder 1' of the invention. Here, the outer shell 10' and the wall defining the inner separation zone 11' are designed as two separate elements. The wall defining inner separation zone 11' is shaped as a connection part 28*a*.

The two contact elements, 8' and 9', are identical, and each have a semi-shell 29 and 29', with clip fastening zones 33, 33' and 34, 34', respectively. On the half-shells 29 and 29' are formed connection parts 30 and 30', which project through the outer shell 10', according to FIG. 10, and form the electrical connection with a current-carrying feed line plug part, not shown in detail.

Figure 11:
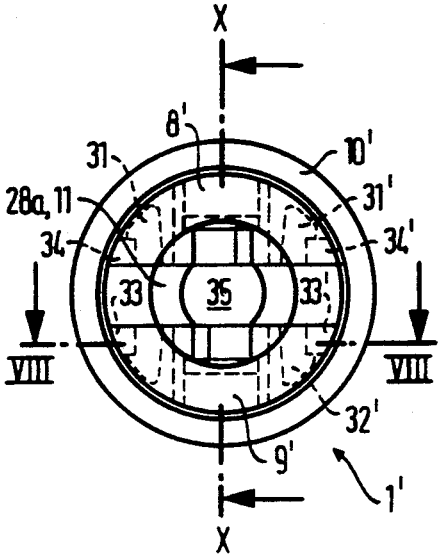
FIG. 11 is a left end view of the lamp holder according to FIG. 10.
Figure 12:
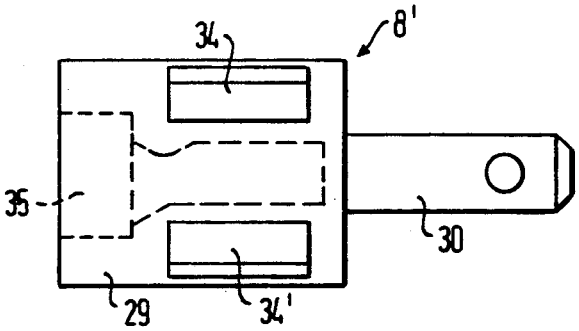
FIG. 12 is a top view of a contact element used in the embodiment of FIG. 10; and, FIG. 13 is a sectional view taken on the line XIII—XIII in FIG. 11.
Figure 13:
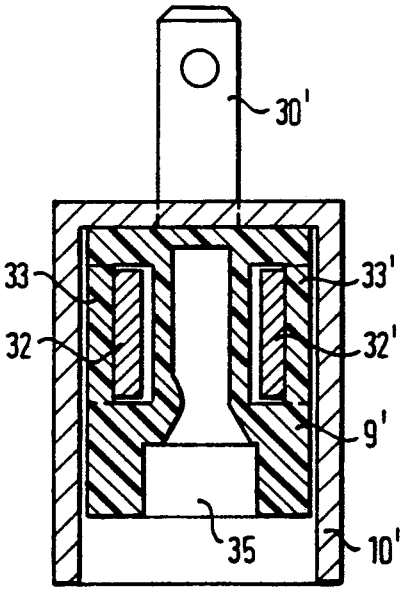

The connection part 28*a* has, on both sides, two locking elements, 31, 31' and 32, 32', respectively, according to FIG. 11. These four locking elements make the connection with the two contact elements 8', 9'.

Here, the locking elements 31 and 31' engage in the respective clip zones 34 and 34' of the upper contact element 8', while the locking elements 32 and 32' engage in the corresponding clip zones 33 and 33' of the lower contact element 9'.

The connection part 28*a* and the two contact elements 8' and 9' form a space 35 inside the outer shell 10', to receive a part of a glass socket lamp 2. Through the connection part 28*a*, the two contact elements 8', 9' are arranged at a spaced distance, insulated from each other, against the connection part 28*a*, this unit being arranged in the inner space of the outer shell 10'. Through this construction there is given, to advantage, a simpler and more cost-saving structure of the lamp holder according to the invention.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

It is now claimed:

1. In a lamp holder to receive an incandescent lamp and having two contact elements supported inside the holder to define a lamp receiving holder zone and which are electrically connected inside the holder zone with contacts of the socket lamp and each contact element having a portion which projects beyond the holder zone the improvement wherein both contact elements are formed from an electroconductive plastic material and wherein the holder has an outer sheath of shell form configuration enclosing the contact elements, and an inner wall defining an inner separation zone inside the holder and insulating the contact elements from each other; and, wherein the one of the contact elements defines an outer contact element set into an inner space between the outer sheath and the wall defining the inner separation zone, and the other contact element defines an inner contact element set into the inner space of the inner separation zone.

2. The improved lamp holder according to claim 1 wherein the outer sheath (10) and the inner wall are formed as a one-piece integral unit.

3. The improved lamp holder according to claim 2 wherein the contact elements are each of shell-like form and wherein the outer sheath is connected by at least one radial web with the wall forming the inner separation zone.

4. The improved lamp holder according to claim 3 wherein the outer sheath is connected with the inner separation zone through three webs which are circumferentially spaced.

5. The improved lamp holder according to claim 3 wherein the inner contact element has two axially aligned socket holes adapted to respectively receive the lamp socket and a current-carrying feed line plug part, at least one of the holes being divided by lengthwise slits to provide radial resiliency.

6. The improved lamp holder according to claim 1 wherein both contact elements are of shell-like form and have, in each case, at least one stop surface lying against at least one shoulder formed on the outer sheath and the wall defining the inner separation zone.

7. The improved lamp holder according to claim 1 wherein the outer contact element has at least one slit which is supported on a radial web extending between outer sheath and the wall defining the inner separation zone.

8. The improved lamp holder according to claim 1 wherein the outer contact element has a neck-like bearing zone sized to correspond to the diameter of the bearing zone of the glass socket lamp to be held.

9. The improved lamp holder according to claim 8 wherein the bearing zone is radially resilient.

10. The improved lamp holder according to claim 1 wherein one of the contact elements extends axially out and beyond the other contact element.

11. The improved lamp holder according to claim 1 wherein the individual contact elements (8, 9) and the outer sheath are made in a two-component injection molding process.

* * * * *